United States Patent [19]

Freeman

[11] Patent Number: 4,637,133

[45] Date of Patent: Jan. 20, 1987

[54] APPARATUS FOR ASSEMBLING RADIATOR COMPONENTS

[75] Inventor: Herbert J. Freeman, Riverview, Mich.

[73] Assignee: Progressive Tool & Industries Company, Southfield, Mich.

[21] Appl. No.: 760,403

[22] Filed: Jul. 30, 1985

[51] Int. Cl.[4] ..... B23P 15/26; B21D 39/00

[52] U.S. Cl. ..... 29/727; 29/33 G; 29/157.3 R; 29/157.4; 29/282; 29/283.5

[58] Field of Search ..... 29/33 G, 33 T, 157.3 R, 29/157.4, 282, 283.5, 727

[56] References Cited

U.S. PATENT DOCUMENTS

| | | | |
|---|---|---|---|
| 4,023,618 | 5/1977 | Kun et al. | 29/157.4 X |
| 4,391,027 | 7/1983 | Fleury | 29/726 X |
| 4,581,818 | 4/1986 | Kondou et al. | 29/727 |

*Primary Examiner*—Howard N. Goldberg
*Assistant Examiner*—R. S. Wallace
*Attorney, Agent, or Firm*—Basile, Weintraub & Hanlon

[57] ABSTRACT

An assembly machine is operable in a single continuous stroke to advance a radiator header plate having a plurality of tube receiving openings onto the ends of a plurality of radiator tubes and to forcibly peripherally expand the tube ends within the openings in the header into a press fit relationship with the header.

10 Claims, 9 Drawing Figures

APPARATUS FOR ASSEMBLING RADIATOR COMPONENTS

BACKGROUND OF THE INVENTION

The present invention is concerned with apparatus for assembling a radiator core subassembly of the type employed in radiators for automotive engine cooling systems. The particular subassembly with which the invention is concerned consists of a pair of opposed headers connected into a rectangular frame by a pair of side frame members extending between the ends of the opposed headers and a plurality of parallel radiator tubes within the frame having their opposite ends seated within openings in the headers.

In the usual case, the headers, frame members and tubes are coated with a brazing compound prior to their assembly; and after the parts have been located in their assembled relationship to each other, the subassembly is passed through an oven to braze the parts to each other into a firmly and permanently fixed assembly.

In prior art apparatus employed to initially assemble the components prior to the brazing step, heavy reliance is placed on frictional fits to hold the components in their assembled positions with the result that the assembly, as removed from the assembly apparatus, is not extremely rigid or firmly assembled. During the transfer of the assembly from the assembly apparatus to the brazing oven, extreme care must be taken to assure that the parts remain, not only in accurate alignment, but also in their assembled relationship.

The apparatus of the present invention is designed to achieve a mechanically sound and rigid assembly of the radiator core by firmly expanding the tube ends into the header openings in a continuation of the same stroke of the assembly apparatus which inserts the tube ends into the header openings.

SUMMARY OF THE INVENTION

In an apparatus embodying the present invention, a pair of header carriers are mounted to extend along opposed sides of a rectangular table and a pair of side frame carriers are mounted along the two remaining opposed sides of the table. Both the header carriers and side frame carriers may be moved relative to the table from respective retracted positions to extended positions in which side frames and headers mounted on the respective carriers are advanced into their final assembled relationship to each other. The table is employed to support a plurality of radiator tubes and tube locating and positioning means are employed, while the various carriers are in their retracted position, to locate the tubes accurately in alignment with the respective openings in the headers carried on the opposed header carriers while these header carriers are in their retracted position. When the header carriers are moved to their extended position, the header carriers are advanced toward the opposed ends of the tubes until the tube ends are inserted into the openings in the respective headers.

In accordance with the present invention, after the tube ends have been inserted into the header openings, tube expanding tools are driven into the ends of the tubes to expand the tube walls tightly against the wall of the header openings.

This expansion is accomplished by mounting each header carrier upon the front of a tool carrier for sliding movement in a forward and rearward direction relative to the tool carrier. The tool carrier itself is mounted upon the machine frame for forward and rearward movement to drive the header carrier between the retracted and extended positions referred to above. Compression spring means are engaged between the tool carrier and header carrier to bias the header carrier forwardly relatively to the tool carrier to a forwardly extended position determined by stop means engageable between the two carriers.

The header carrier is formed with an elongate central opening, and header mounting means on the front side of the tool carrier are employed to detachably mount a header upon the header carrier with the header extending across the front of the central opening. The tool carrier carries a plurality of expansion tools which, upon rearward movement of the header carrier relative to the tool carrier, can advance through the central opening in the header carrier and into the end of tubes located within the header openings to perform the tube expanding operation.

Upon forward movement of the tool carrier toward its forward end limit of movement relative to the frame, the header carrier is held at its normal forwardly extended position relative to the tool carrier by the compression springs engaged between the tool and header carriers. When the header carrier has been advanced to its extended position relative to the frame, at which the ends of the tubes are located within the openings in the header, the header carrier engages a fixed stop on the frame which prevents further forward movement of the header carrier. The tool carrier, however, continues to move forwardly to drive the expansion tools into the ends of the tubes to expand the tubes as the tool carrier reaches its forward end limit of movement.

To firmly hold the header against distortion as the expansion tools are driven into the ends of the tubes, a pair of bracing plates are mounted on the front of each header carrier above and below the header. When the header carrier is at its forwardly extended position relative to the tool carrier, the bracing plates are maintained in a normal retracted position clear of the header supported on the header carrier. Relative motion between the tool carrier and header carrier, after the header carrier has been driven against the fixed stop, is employed to drive the bracing plates respectively downwardly and upwardly into engagement with the front of the header to brace the header during the expansion operation.

Other objects and features of the invention will become apparent by reference to the following specification and to the drawings.

IN THE DRAWINGS

DESCRIPTION OF THE PREFERRED EMBODIMENT

Figure 7:
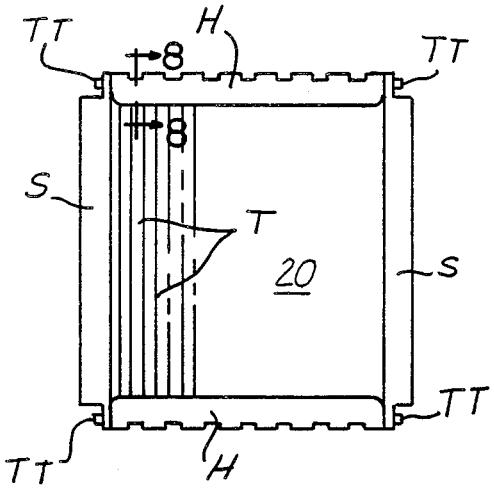
FIG. 7 is a front view of a radiator core subassembly of the type assembled by the apparatus.
Figure 8:
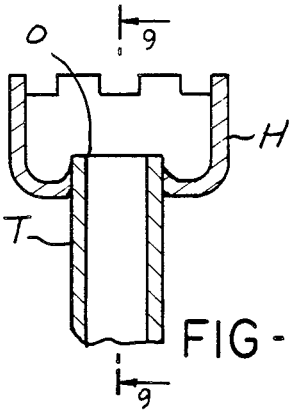
FIG. 8 is a partial cross-sectional view of the radiator core of FIG. 7 taken on the line 8—8 of FIG. 7.
Figure 9:
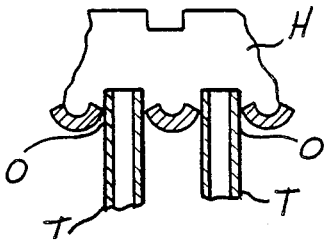
FIG. 9 is a cross-sectional view of a portion of the radiator subassembly taken on the line 9—9 of FIG. 8.

The apparatus of the present invention is designed to assemble a radiator core subassembly of the type shown in FIGS. 7 through 9 of the drawings. Referring to FIGS. 7-9, this subassembly includes a rectangular peripheral frame made up of a pair of headers H which form two opposed sides of the frame, a pair of side frame members S joined to and extending between the ends of the headers, and a plurality of radiator tubes T which extend in spaced parallel relationship to each other with the opposite ends of the tubes T being seated in openings O formed in the headers. The headers H are secured to the side frame members S by tabs TT, the tabs TT are formed on the headers H and are seated in slots (not shown) in the ends of side frames S as the headers are moved into assembled relationship with the side frame members by the assembly apparatus in a manner to be described below. After being located in the slots, the apparatus bends the tabs TT into tightly clamped relationship with the side frame members. The apparatus also, as will be described below, drives an expansion tool into each end of each tube, after the tube has been located within the header opening O to deformably expand the tube end into a tightly mechanically clamped relationship within the header opening.

Figure 1:
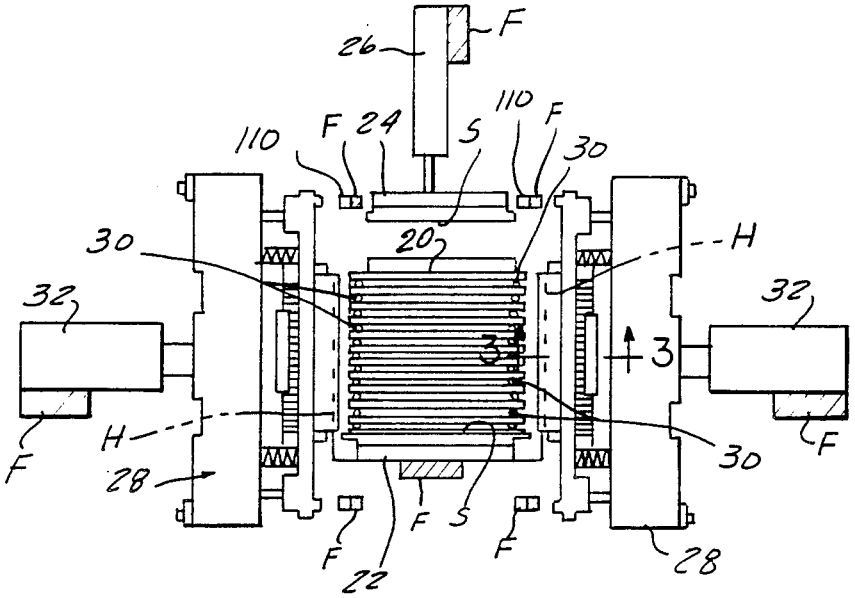
FIG. 1 is a schematic top plan view of an apparatus embodying the present invention.

The overall organization of the apparatus of the present invention, which functions to assemble the radiator core assembly shown in FIG. 7, is best seen in the schematic diagram of FIG. 1. Referring now to FIG. 1, the apparatus includes a rectangular table 20 mounted on the fixed frame F of the apparatus. Side frame carriers 22, 24 extend along two opposed sides of table 20 and are provided with means, not shown, for detachably supporting side frame members S in spaced, opposed relationship. Side frame carrier 22 is fixedly mounted on the machine frame F, while side frame carrier 24 is mounted upon the piston rod of a hydraulic cylinder 26 for movement between a retracted position clear of table 20 shown in FIG. 1 and an extended position in which carrier 24 has been advanced toward carrier 22 to locate the side frame S carried on side frame carrier 24 at the spacing from the side frame S on carrier 22 required in the final assembly of the radiator core.

A pair of like header carrier assemblies designated generally 28 are mounted at the two remaining opposed sides of table 20 for movement relative to the machine frame F toward and away from each other. The header carrier assemblies 28 are movable between the retracted position shown in FIG. 1 and extended positions in which headers H detachably mounted on the fronts of the respective header carriers are advanced toward each other into their final assembled spaced relationship.

Table 20 provides a support upon which the radiator tubes T are located when the various carriers are in their retracted positions referred to above. As best seen in FIGS. 8 and 9, the tubes T are of an elongate, rectangular, transverse, cross-sectional configuration and, returning to FIG. 1, are supported in spaced, parallel relationship on their narrow sides on table 20 by a series of locating pins 30 which, for purposes of the present application, may be considered as being fixed relative to the machine frame. The pins 30 have a diameter equal to the desired spacing between adjacent tubes T corresponding to the final assembled spacing, and the pins 30 are spaced from each other by a distance substantially equal to the thickness of the individual tubes. In practice, the locating pin structure is somewhat more complex, and is disclosed and described in detail in a commonly owned co-pending application Ser. No. 742,975 filed June 10, 1985.

Broadly speaking, the operational sequence of the apparatus as shown in FIG. 1 is to first locate the carriers 24 and 28 in their retracted positions. Side frame members S are then manually detachably mounted on side frame carriers 22 and 24 and headers H are detachably mounted on the fronts of the respective header carrier assemblies 28. The tubes T are then placed in position between the locating pins 30 on table 20, the pins aligning the tubes with the openings in the headers H mounted on the header carriers. Cylinder 26 is then actuated to advance the side frame S carried on carrier 24 into its final assembled spacing from the side frame S on fixed carrier 22. Hydraulic cylinders 32 are then actuated to drive header carrier assemblies 28 toward each other, this movement advancing the headers H until the opposed ends of the tubes are located within the openings in the respective headers. Subsequent operation of the header carrier assemblies 28, in a manner to be described in more detail below, expands the tube ends within the header openings and bends the tabs TT to clamp the headers H to the side frames S.

The present invention is directed to the construction of the header carrier assemblies 28. Header carrier assemblies 28 are of identical construction and the following description of one header carrier assembly is equally applicable to the other.

Referring now particularly to FIGS. 2 through 5, the header carrier assembly 28 includes two major subassemblies, namely, a header carrier unit 34 and a tool carrier unit designated generally 36. Tool carrier 36 is mounted for forward and rearward movement upon fixed frame F upon guide rails 38 (FIGS. 4 and 5) mounted on the fixed frame of the machine. Tool carrier 36 is fixedly secured to the piston rod 40 of cylinder 32 which drives tool carrier 36 in reciprocatory movement along the guide rails.

Figure 5:
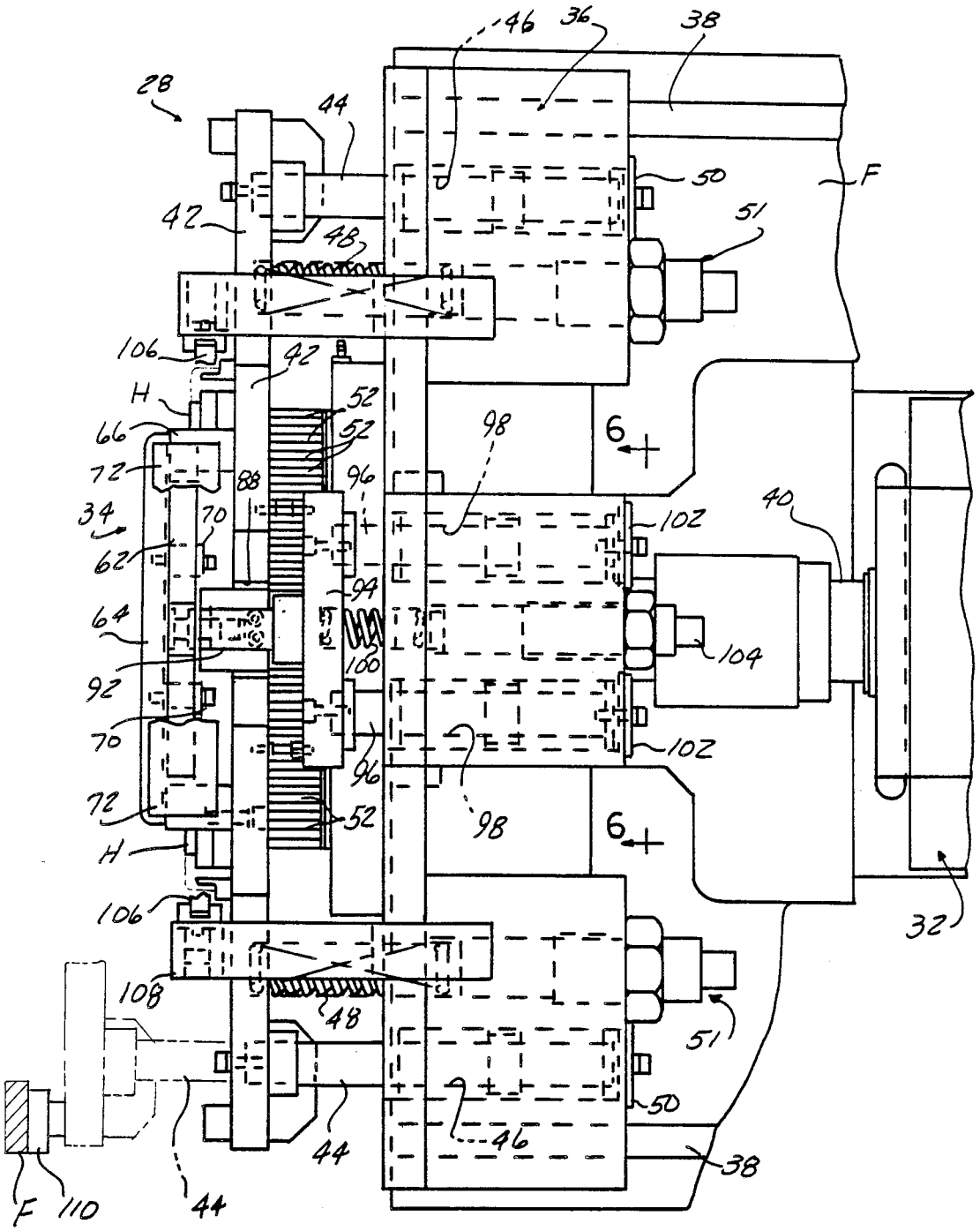
FIG. 5 is a top plan view of a portion of the apparatus.

Header carrier 34 includes a main carrier plate 42 to which four rearwardly projecting guide rods 44 are fixedly mounted. Guide rods 44, as best seen in FIG. 5, project rearwardly from the back of main plate 42 and are slidably received within bores 46 through tool carrier 36 to support header carrier 34 upon tool carrier 36 for forward and rearward movement relative to tool carrier 36 in front of the tool carrier. A pair of relatively heavy compression springs 48 are engaged between tool carrier 36 and main plate 42 of the header carrier to bias header carrier 34 to a forward end limit of movement relative to tool carrier 36 determined by the engagement of stop washers 50 (FIGS. 2 and 5) with the rearward side of the tool carrier. The compressive force of springs 48 may be adjusted by an adjustment mechanism designated generally 51 (FIG. 5).

Figure 3:
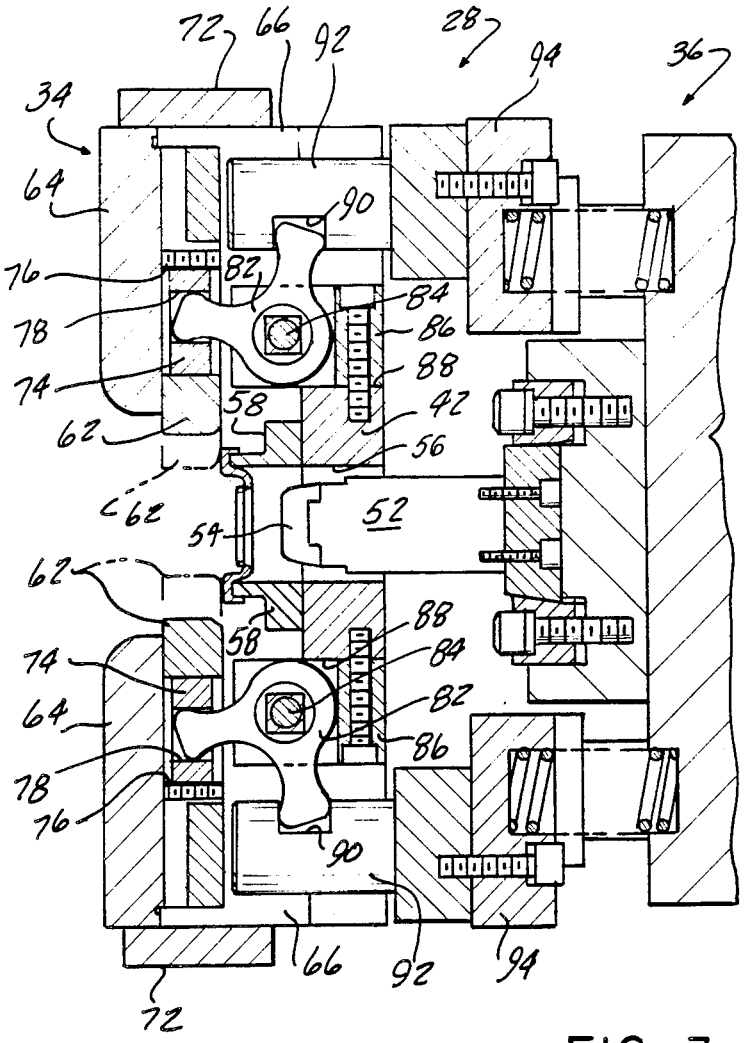
FIG. 3 is a cross-sectional view taken on the line 3—3 of FIG. 1.

Referring now particularly to FIGS. 3 and 5, a plurality of individual tube expansion tools 52 are fixedly mounted on the front of tool carrier 36 and project forwardly from the tool carrier in a spaced parallel relationship (FIG. 5) to each other which corresponds to the spacing between the tubes T in the assembled radiator core. The forward tip 54 of each of tools 52 is formed to be inserted in the tube end during the final stage of the assembly operation to expand and deform the tube end into firmly clamped engagement with the periphery of the opening within header H.

Main header plate 42 is formed with an opening 56 (FIGS. 3 and 4) which accommodates forward and rearward movement of the tools 52 through the header plate 42.

Figure 4:
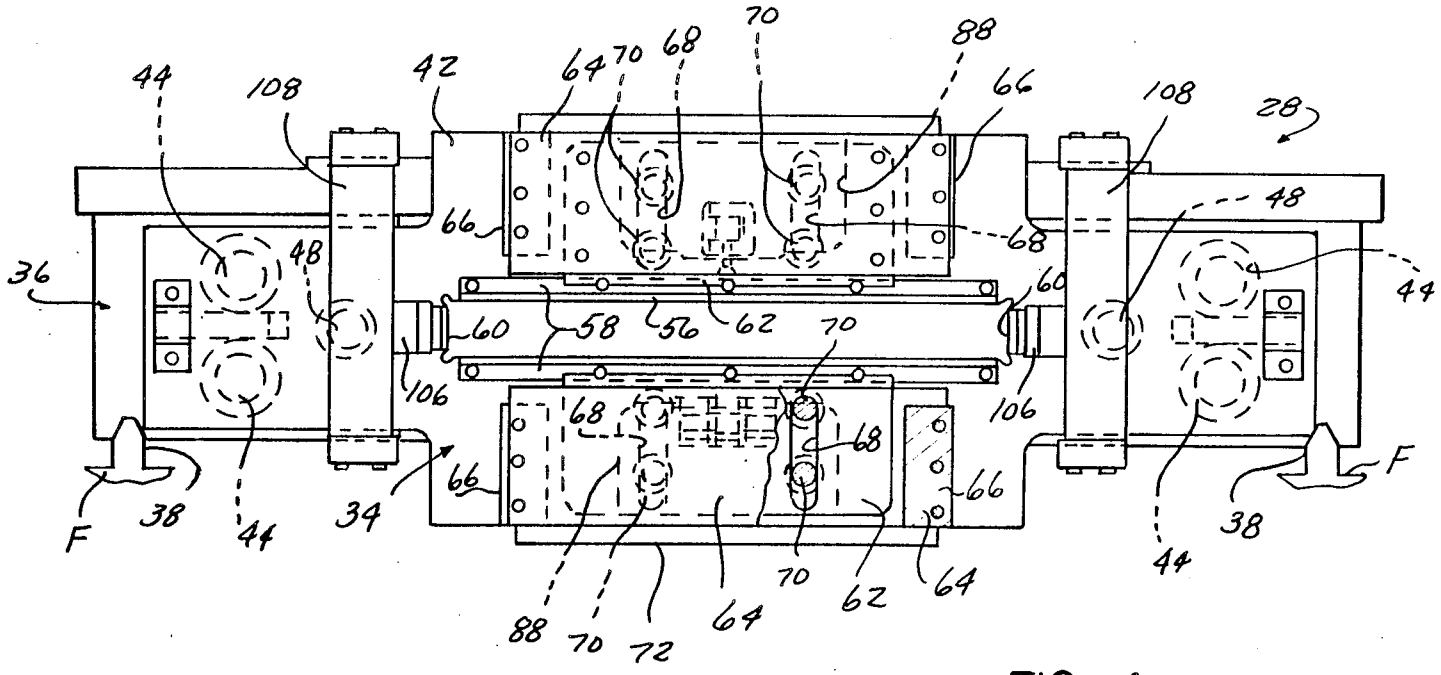
FIG. 4 is a front elevational view of the apparatus taken from the plane 4—4 of FIG. 2 with certain parts broken away.

Referring now particularly to FIG. 4, header mounting strips 58 are fixedly mounted on the front of main header plate 42 to extend for substantially the entire length of opening 56 immediately above and below opening 56. Relatively short header mounting strips 60 are likewise fixedly secured to the front of header plate 42 along each of the opposite ends of opening 56. Referring now to the cross-sectional view of FIG. 3, it is seen that the header mounting strips 58 are formed with a cross-sectional configuration related to that of the header H so that the strips 58 may be frictionally engaged within recesses formed on the header to detachably support the header H in front of opening 56 in main header plate 42 with the openings O in header H respectively aligned with the individual expansion tools 52.

To retain the header firmly against forward movement or deflection during the final stages of the assembly process, vertically movable bracing plates 62 (best seen in FIG. 3) are mounted for sliding movement on header carrier 34 between a retracted position shown in full line in FIG. 3 and an extended or active position indicated in broken line in FIG. 3 wherein the plates engage the front of the header. Plates 62 are mounted for vertical sliding movement in a housing which includes a front plate 64 fixedly mounted on main carrier plate 42 in forwardly spaced, parallel relationship to the main plate 42 as by four spacer blocks 66 (FIG. 4). As best seen in FIG. 4, where the right-hand end of the lower front plate 64 has been broken away to expose a part of the lower bracing plate 62, the bracing plates are formed with vertically elongate slots 68 through which bolts 70 threaded into the front plate 64 are passed, the heads of the bolts 70 being disposed at the rearward side of the bracing plate 62 to maintain the bracing plate in sliding contact with the rearward or inner face of the front plate 64 while the vertical slots cooperate with the bolts 70 to guide the bracing plate 62 in vertical movement. Stiffening plates 72 are welded to the front plates 64 and spacers 66 to stiffen front plates 64 against deflection.

Referring now to FIG. 3, bracing plates 62 each include an insert 74 fixedly mounted within an opening 76 through the plate, the inserts in turn having a central opening 78 which receives one arm of a bell crank 82. Bell crank 82 is mounted for pivotal movement about a pivot shaft 84 which is in turn mounted upon main plate 42 by a channel-shaped pivot support member 86 fixedly bolted into a recess 88 in plate 42. The opposite arm of bell crank 82 is received within a slot 90 cut in a push rod 92.

Figure 6:
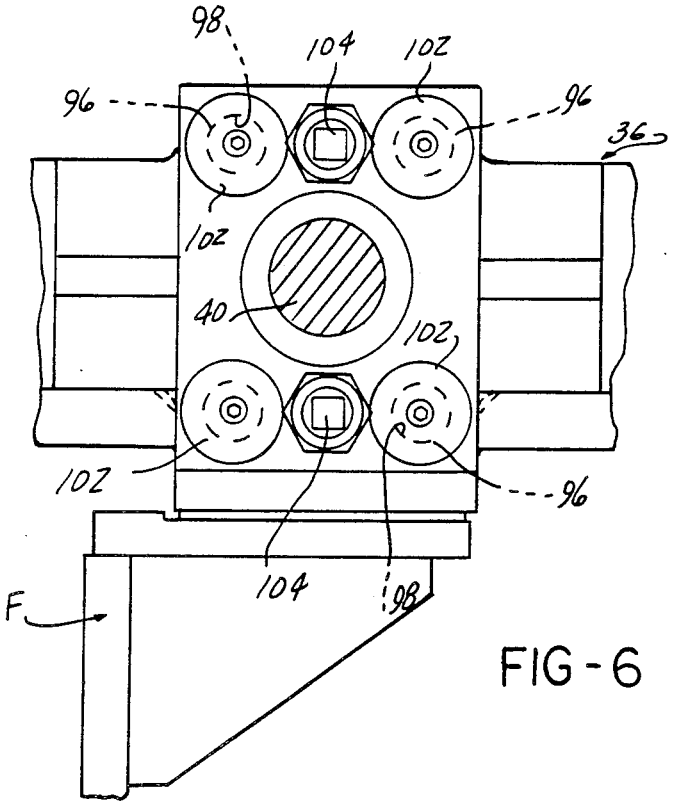
FIG. 6 is a partial cross-sectional view taken on the line 6—6 of FIG. 5.

Referring now particularly to FIGS. 3 and 5, each push rod 92 is fixedly mounted on a transversely extending actuating plate 94 and guide rods 96, one adjacent each end of the plate 94 as best seen in FIG. 5, project rearwardly from plate 94 through bores 98 which extend rearwardly through tool carrier 36 to slidably support actuating plate 94 for forward and rearward movement relative to the tool carrier. A compression spring 100 is engaged between the tool carrier and actuating plate 94 and, as was in the case with guide rods 44 which support header carrier 34 in the tool carrier, a forward end limit of movement of actuating plate 94 relative to tool carrier 36 is established by stop washers 102 bolted to the rearward end of guide rods 96 and engageable with the rear side of tool carrier 36 (see also FIG. 6). The compressive force of spring 100 may be adjusted by a stud 104 threadably received in the tool carrier and bearing against the rear or right-hand end of spring 100 as viewed in FIG. 5.

Cams 106, shown only in FIGS. 4 and 5, are mounted on brackets 108 fixedly mounted upon tool carrier 36 and projecting forwardly from the tool carrier to locate the cams 106 in front of main plate 42 of header carrier 34. Cams 106 engage the tabs TT on headers H during the final stages of the forward stroke of the tool carrier to bend the tabs TT into firmly clamped relationship within slots in the side frame members S.

Stops 110 (FIGS. 1, 2 and 5) are mounted upon the fixed frame F in the path of movement of the header carrier 34 for a purpose to be described below in connection with the operation of the apparatus.

The overall operation of the apparatus has been described above generally, and the following operational description is directed primarily to the detailed functioning of the components of the header carrier assemblies 28.

As described above, at the commencement of an assembly cycle, the header carrier assembly 28 is located in a retracted position with the header carrier unit 34 of the assembly biased to its forward end limit of movement relative to the tool carrier 36 portion by springs 48. A header H is mounted upon the header carrier, as described above and shown in FIG. 3, with the bracing plates 62 in their retracted or inactive position as shown in FIG. 3. At this time, tubes T are supported with their ends spaced forwardly from the header carrier assembly upon table 20 with each of the tubes disposed in alignment with the tube receiving opening O in header H and with an expansion tool 52 which, at this moment, is positioned relative to the header H as illustrated in FIG. 3.

Figure 2:
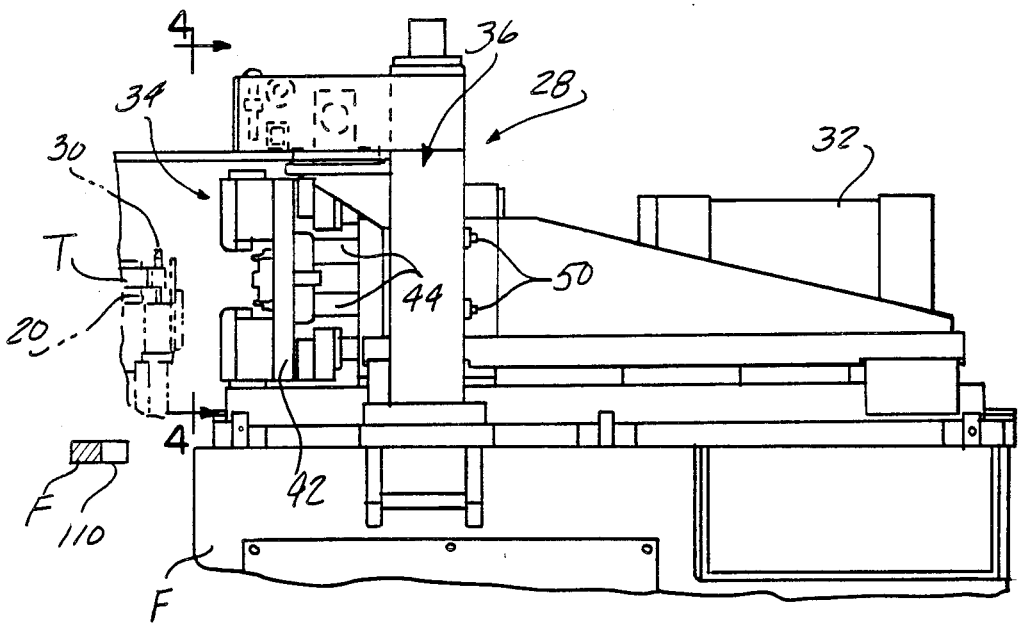
FIG. 2 is a partial side elevational view of the apparatus.

Upon actuation of the drive cylinder 32, tool carrier 36, which is coupled directly to the piston rod 40 of cylinder 32, is driven forwardly or to the left as viewed in FIGS. 2, 3 and 5. The header carrier biasing springs 48 maintain the initial or normal front-to-rear spacing between the header carrier unit 34 and tool carrier 36 in FIGS. 3 and 5 until the header carrier is advanced into engagement with the stops 110 (FIGS. 1 and 5), at which time further forward movement of the header carrier unit 34 of the header carrier assembly 28 is stopped. The stops 110 are so located that at the time unit 34 engages the stops, the header H carried by header carrier unit 34 has been advanced to a point where the end of the tubes T on table 20 are seated within the openings O within the header H carried on the header carrier and the tubes, headers and side frames S are all in their final assembled positions relative to each other.

Although the stops 110 are effective in holding header carrier unit 34 against further forward movement, the tool carrier 36 portion of the unit continues to drive forward under the action of cylinder 32.

This continued forward motion of tool carrier 36 relative to the now stationary header carrier unit 34 is accommodated on guide rods 44 slidably received in the tool carrier and is opposed by the compressive forces of springs 48. This relative forward movement of tool carrier 36 relative to unit 34, referring now to FIG. 3, drives the forward tips 54 of the tools 52 forwardly through the stationary header carrier unit 34 and into the end of the tubes T which are located within the openings in the header. As explained above, the driving of the tool 52 into the tube end peripherally deforms and expands the tube against the walls of the header openings to achieve a solid press fit of the tube to the header.

The forward motion of tool carrier 36 relative to unit 34, after unit 34 has engaged stops 110 on the frame, also advances the push rods 92 of the bell crank actuators forwardly relative to the now stationary unit 34. Referring particularly to FIG. 3, this forward movement of the rods 92 drives the upper bell crank about its pivot 84 in counterclockwise rotation to thereby drive the upper bracing plate 62 downwardly, while the relative forward movement of the lower push rod 92 drives the lower bell crank 82 in clockwise movement about its pivot 84 to elevate the lower bracing plate 62 into engagement with the front of the header. Movement of the actuating rods 92 is correlated with the advancing movement of the tip 54 of the tools so that the bracing plates 62 arrive at their active position indicated in broken line in FIG. 3 just as the tool 52 begins to contact the tube seated in the opening in the header.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. An assembly apparatus for locating and fixing one end of a tube to a header within a tube receiving opening in the header, said apparatus comprising a frame, a tool carrier mounted on said frame for forward and rearward movement between spaced front and rear end limits, an expansion tool fixedly mounted on and projecting forwardly from said tool carrier for movement with said tool carrier to be located in a retracted position when said tool carrier is at its rear end limit and to be located at an extended position when said tool carrier is at said front end limit, said tool being operable when driven into the end of a tube to peripherally expand the tube end, a header carrier, means mounting said header carrier on said tool carrier for forward and rearward movement relative to said tool carrier in front of said tool carrier, spring means engaged between said tool carrier and said header carrier biasing said header carrier forwardly from said tool carrier to a selected end limit of forward movement relative to said tool carrier, said header carrier having a passage therethrough accommodating free movement of said tool through said header carrier upon movement of said header carrier relative to said tool carrier, header mounting means for detachably mounting a header on the front of said header carrier with the tube receiving opening in the header aligned with said tool, means operable when said tool carrier is at its rear end limit for locating a tube on said frame with one end of said tube aligned with said tube receiving opening and said tool and spaced forwardly from said header and rearwardly of the extended position of said tool, drive means for driving said tool carrier forwardly from its rear end limit to advance said header and said tool toward said tube, and stop means for stopping forward movement of said header carrier when said one end of said tube is located within the tube receiving opening in said header while accommodating continued forward movement of said tool carrier to said front end limit.

2. The invention defined in claim 1 wherein means mounting said header carrier comprises a plurality of guide rods fixedly mounted on said header carrier and projecting rearwardly therefrom, means on said tool carrier defining passages extending therethrough from front to rear slidably receiving said guide rods, the ends of said guide rods projecting rearwardly beyond said tool carrier, and means on the ends of said guide rods engageable with said tool carrier to establish said selected end limit of forward movement of said header carrier relative to said tool carrier under the biasing action of said spring means at a location such that forward movement of said tool carrier after said header carrier has been stopped by said stop means drives said expansion tool forwardly through said passage in said header carrier into the end of the tube located within the tube receiving opening of the header mounted on said header carrier.

3. The invention defined in claim 2 further comprising header bracing means movable from a retracted position clear of a header on said header mounting means to an active position wherein said bracing means engages the front of said header to maintain the header against forward movement relative to said header carrier, and actuating means responsive to forward movement of said tool carrier relative to said header carrier for shifting said bracing means from its retracted position to its active position.

4. The invention defined in claim 3 wherein said bracing means comprises a bracing plate mounted on said header carrier for vertical sliding movement relative to said header carrier between a first end limit corresponding to the retracted position of said bracing means and a second end limit corresponding to the active position of said bracing means, and said actuating means comprises an actuating member mounted on said tool carrier and projecting forwardly therefrom, and coupling means coupling said actuating member to said bracing plate to drive said bracing plate in vertical movement in response to relative movement between said tool carrier and said header carrier.

5. The invention defined in claim 4 wherein said coupling means comprises a bell crank mounted on said header carrier for pivotal movement about a horizontal axis normal to the direction of movement of said tool carrier, a first arm of said bell crank being coupled to said bracing plate to drive said bracing plate in vertical movement in response to pivotal movement of said bell crank, and a second arm of said bell crank being coupled to said actuating member to drive said bell crank in pivotal movement in response to relative movement between said actuating member and said header carrier.

6. The invention defined in claim 5 further comprising means mounting said actuating member in said tool carrier for forward and rearward sliding movement relative to said tool carrier, and spring means engaged between said tool carrier and said actuating member biasing said actuating member to a forward end limit of movement relative to said tool carrier.

7. Apparatus for assembling a plurality of radiator tubes to a radiator header with the ends of said tubes projecting through and fixed within openings in said header and the tubes projecting in spaced parallel relationship from said header, said apparatus comprising a frame, a tool carrier mounted on said frame for forward and rearward movement along a fixed path between forward and rearward end limits, power means for driving said tool carrier between said forward and rearward end limits, a plurality of expansion tools mounted on said tool carrier and projecting forwardly from the front of said tool carrier in a spaced parallel relationship corresponding to the spaced parallel relationship of said tubes when assembled to said header, each of said tools being operable upon insertion into a tube end to peripherally expand the tube end, a header carrier, means mounting said header carrier upon said tool carrier for forward and rearward movement relative to said tool carrier with said header carrier disposed in front of said tool carrier, spring means engaged between said tool carrier and said header carrier biasing said header carrier forwardly from said tool carrier, first stop means defining a forward end limit of movement of said header carrier relative to said tool carrier, said header carrier having a passage therethrough accommodating forward and rearward movement of said tools through said header carrier upon relative movement between said header carrier and said tool carrier, means for mounting a header on said header carrier with said header extending across the front of said passage and the openings in said header respectively aligned with said tools, tube locating means on said frame for locating a plurality of tubes in spaced parallel relationship in respective alignment with said tools and the openings in a header mounted on said header carrier with the ends of said tubes uniformly spaced from the front side of the header when said tool carrier is at its rearward end limit and said header carrier is at its forward end limit relative to said tool carrier, second stop means on said frame operable upon forward movement of said tool carrier from its rearward end limit to stop forward movement of said header carrier when the header mounted on said carrier has been advanced to receive the ends of the tubes located on said locating means within the openings in the header while accommodating further forward movement of said tool carrier relative to said header carrier to advance said expansion tools forwardly through said passage in said header carrier and into the ends of the tubes received in the header openings to expand the tubes tightly to the header as said tool carrier moves to its forward end limit.

8. The invention defined in claim 7 further comprising header bracing means mounted on said header carrier for movement between a retracted position clear of a header mounted on said header carrier and an active position wherein said bracing means is positioned against part of the upper and lower portions of said header to brace said header against forward movement relative to said header carrier, and actuating means operable upon forward movement of said tool carrier relative to said header carrier for moving said bracing means from said retracted position to said active position.

9. The invention defined in claim 8 wherein said bracing means comprises an upper and a lower bracing plate mounted on said header carrier for vertical sliding movement between said retracted position wherein said plates are respectively disposed above and below the top and bottom of the header on said mounting means and said active position, and said actuating means comprises upper and lower bell crank means pivotally mounted on said header carrier, each having one arm respectively engaged with said upper and lower plates, and upper and lower actuating rod means on said tool carrier projecting forwardly from said tool carrier and coupled respectively to the other arms of said upper and lower bell crank means to locate said plates in their retracted position when said header carrier is at its forward end limit of movement relative to said tool carrier and to pivot said bell crank means to drive said plates to their active position upon forward movement of said tool carrier subsequent to the engagement of said header carrier with said second stop means.

10. The invention defined in claim 9 wherein the forward ends of said expansion tools are spaced rearwardly from a header mounted on said mounting means when said header carrier is at its forward end limit of movement relative to said tool carrier by a distance such that forward movement of said tool carrier subsequent to the engagement of said header carrier with said second stop means is operable via said actuating rods and said bell crank means to move said bracing plates to their active position prior to the engagement of said expansion tools with said tubes.

* * * * *